United States Patent [19]

Lawrence

[11] 4,103,440

[45] Aug. 1, 1978

[54] SHOE WITH DETACHABLE UPPER

[76] Inventor: Peter A. Lawrence, 27215 SE. Duthie Hill Rd., Issaquah, Wash. 98027

[21] Appl. No.: 824,424

[22] Filed: Aug. 15, 1977

[51] Int. Cl.[2] ..... A43B 3/24

[52] U.S. Cl. ..... 36/101

[58] Field of Search ..... 36/100, 101, 50, 28, 36/30 R, 32 R

[56] References Cited

U.S. PATENT DOCUMENTS

| | | | |
|---|---|---|---|
| 2,430,338 | 11/1947 | Heiman | 36/101 X |
| 2,686,376 | 8/1954 | Burkholz | 36/101 X |
| 2,809,449 | 10/1957 | Smith | 36/101 |

*Primary Examiner*—Patrick D. Lawson

*Attorney, Agent, or Firm*—Graybeal, Barnard & Uhlir

[57] ABSTRACT

The lower stringer of a slide fastener means is attached to an upstanding side wall of a sole, which side wall extends around the perimeter of the sole; the complementary upper stringer is attached to the lower edge portion of the upper, which loser edge portion extends around the perimeter of said upper. With the shoe disassembled, the tape of the upper stringer lies adjacent of the outer surface of the upper and carries coupler means directed upwardly. To assemble the shoe, the upper stringer tape is folded outwardly and downwardly over on itself to form an upwardly directed bight and thus dependently locating the coupler means of the upper stringer directly above the coupler means of the lower stringer so that slide fastener means can couple the two said coupler means. A removable heel cup, for reinforcing the heel region of the upper, is upwardly insertable into a heel pocket formed in the rear of the upper. Furthermore, a removable, multi-layered insole, which is contoured corresponding to the outline of the outer edge of the sole, is closely receivable within the sole side walls to sandwich therebetween the lower edge portion of said upper and the lower stringer tape.

7 Claims, 7 Drawing Figures

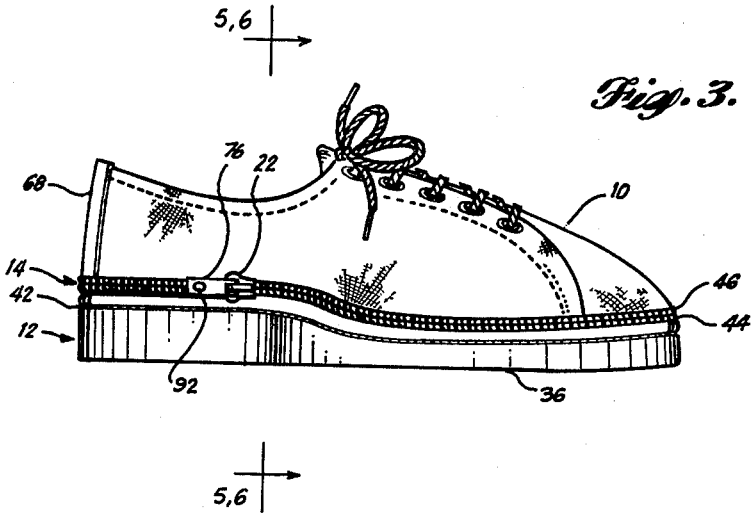
Fig. 3.
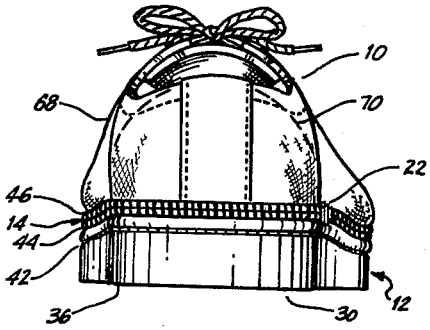
Fig. 4.
Fig. 5.
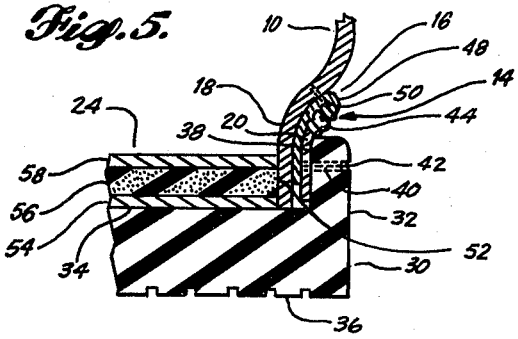
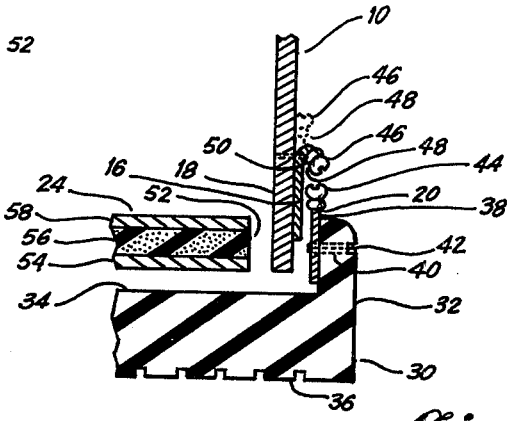
Fig. 6.
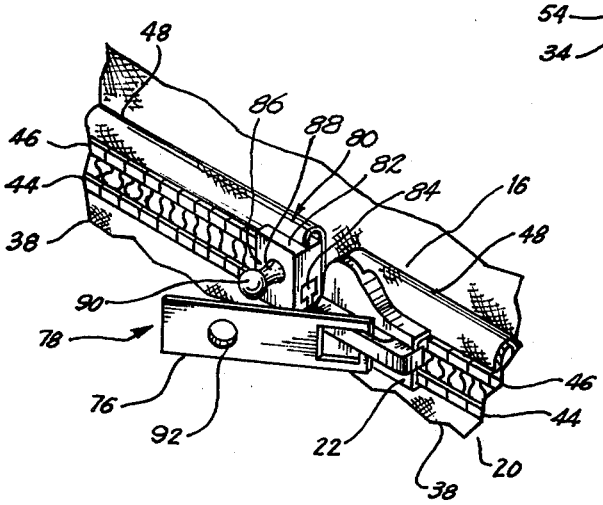
Fig. 7.

SHOE WITH DETACHABLE UPPER

FIELD OF THE INVENTION

This invention relates to shoes, and in particular to shoes assembled from detachable components for enabling wornout components to be easily replaced and for enabling components to be interchanged to vary the application or usage, style, shape and fit of the shoe.

DESCRIPTION OF THE PRIOR ART

Components of shoes usually wear out at different rates depending on particular usage. When a component does wear out, the shoe is either repaired or discarded, which discarding is wasteful since the remaining parts of the shoe often still have useful life. However, if the shoe is repaired by replacing the worn-out part by conventional techniques, because the substitute part is usually not identical to the original component and because the method of assembling such substitute part to the shoe may be different than in the original construction of the shoe, and fit and comfort of the original shoe may be altered. This change in fit and comfort is especially important in athletic type shoes which are often purchased for a particular fit or "feel", rather than primarily for style. Thus, it would be desirable for the purchaser to be able to replace the worn-out shoe component with identical parts and in the same manner as in the original shoe.

Furthermore, it is desirable to be able to change the structure and characteristics of a shoe, and thus convert it to different uses, simply by interchanging its components. This would be especially advantageous in athletic shoes which often require similar leather or fabric upper, with the major design variation occurring in the shape and construction of the sole. For best performance tennis shoes, for example, require relatively heavy, durable, molded rubber soles; jogging shoes require a lightweight, flexible sole; and track shoes require lightweight, flexible cleated soles. All of these types of athletic shoes, however, have similarly constructed uppers. In addition to being able to interchange soles of various structures and characteristics, it is also preferable for the purchaser to be able to substitute insoles of varying thicknesses and flexibilities and also heel cups of different shapes and flexibilities.

It is, moreover, desirable to be able to convert shoes to match the particular wardrobe being worn. Often shoes constructed with the same upper can be purchased with different types of soles, a hard leather sole for business or formal wear or a crepe or wood sole for casual wear. Also, shoes having a common sole can be purchased with different styled uppers or different colored uppers. Thus, a shoe constructed so that its constituent parts can be readily interchanged would enable a consumer to purchase a small number of basic components and then assemble shoes to be worn on different occasions or to assemble shoes of different colors.

Moreover, shoes worn by medical, laboratory or food processing personnel must be maintained in sanitary condition. A shoe constructed of a fabric upper such as nylon or canvas would allow the upper to be cleaned by normal laundry or drycleaning processes. The chemicals, soap and heat, commonly used in these cleaning processes, however, can damage rubber or leather used in the sole or insole. If the upper were detachable from the sole, such upper could be cleaned without harming the sole or insole.

Shoes having uppers detachably connected to the sole through the use of a slide fastener or "zipper" are known. Generally, one stringer tape of the slide fastener is attached to the top surface of a flat sole; the companion stringer tape is attached to the lower edge portion of the upper. One type of shoe conforming to this general construction has a removable insole which simply sits on top of the flat sole. Another type of shoe has an insole which forms an integral portion of the upper. One disadvantage of these types of shoes is that no structure is provided to prevent a foot from sliding against or slipping over the slide fastener. Such unrestrained foot movement not only can cause irritation to the foot by rubbing against the slide fastener, but also can result in the slide fastener becoming uncoupled or damaged from the shock loads imparted thereto by the foot.

Another disadvantage results from the bottom stringer tape being attached to the top surface of the sole by an adhesive, which is commonly used in this situation. The wearer's foot, especially during walking and running, imparts an upwardly directed force on the bottom stringer tape. Thus, the adhesive joint is loaded in tension, in which mode of loading an adhesive joint is the weakest.

A further disadvantage stems from an inadequate amount of cushioning material being provided between the foot and the slider. This causes discomfort to the wearer, regardless of whether the foot bears directly or indirectly against the slider means.

Examples of shoes having an upper detachably connected to a sole by a slider fastener are disclosed by the following U.S. Pat. Nos. 2,200,080, granted May 7, 1940, to Jacob Fein; 2,205,091, granted June 18, 1940, to Samuel H. Geffner; 2,261,125, granted Nov. 4, 1941, to Francis I. McFeely; 2,302,596, granted Nov. 17, 1942, to Albert Bigio; and 2,839,845, granted June 24, 1958, to Walter Charles Calvin Burton, Jr. These patents and the prior art that was cited and considered by the Patent Office before granting them, and which is listed on the patents, should be consulted for the purpose of properly evaluating the subject invention and putting it into proper perspective.

SUMMARY OF THE INVENTION

The instant invention relates to a novel shoe constructed of easily replaceable components, in basic form composed of an upper detachably connected to a sole by slide fastener means. The sole is constructed of a tread portion and an upstanding side wall extending around the perimeter of the tread portion. The upper has a lower edge portion extending around its perimeter, and a heel pocket for receiving a heel cup, as is hereinafter discussed in detail. The slide fastener means includes a lower stringer attached to the sole, an upper stringer attached to the upper, and slider means for coupling and uncoupling the stringers. The lower stringer is composed of a mounting tape attached to the inside surface of the sole side wall, and first coupler means carried by the upper edge of said lower stringer mounting tape to extend along the perimeter of the sole at an elevation above the top of the sole side wall. The upper stringer is composed of a mounting tape attached to the outside of the lower edge portion of the upper, and an upwardly directed second coupler means extending along an edge portion of said upper stringer mounting tape. To assemble the shoe, the upper stringer tape is folded outwardly and downwardly over on itself forming an upwardly directed bight. The second coupler means is thus located laterally, outwardly of the upper and above the top of the sole side wall. A multi-layered removable insole, contoured corresponding to the outline of the outer edge, is closely receivable within the sole side wall. The lower stringer tape and the lower edge portion of the upper, which are both sandwiched between the insole and the sole side wall, cushion the wearer's foot from the slide fastener means. Moreover, securing means may be provided to prevent the slider means from sliding along the upper and lower stringers and thus to maintain the upper and lower stringers in interlocked relationship.

It is an object of the present invention to provide a shoe constructed of interlocking components which can be assembled together without requiring any gluing, stitching or bonding.

Another object of the present invention is to provide a shoe having component parts which can be easily replaced by the purchaser to prolong the useful life of the shoe but without requiring any gluing, stitching or bonding.

A further object of the present invention is to provide a shoe having components which can be rapidly and easily interchanged to adapt the shoe to different uses, styles, and support and flex characteristics, while still maintaining the appearance of a conventional shoe.

Still another object of the present invention is to ensure that when a worn-out shoe part is replaced, the original fit and comfort will be maintained.

An additional object is to provide a shoe which may be readily disassembled to enable selective cleaning of component parts.

BRIEF DESCRIPTION OF THE DRAWINGS

FIG. 3 is a side elevation of the shoe as assembled;

FIG. 4 is a rear elevation of the shoe shown in FIG. 3;

FIG. 5 is an enlarged, fragmentary cross-section of the shoe shown in FIG. 3, taken substantially along lines 5—5 thereof;

FIG. 6 is an exploded view substantially similar to that shown in FIG. 5 with the upper stringer, prior to being bent over on itself during assembly, shown in phantom; and FIG. 7 is an enlarged pictorial view illustrating the securing means for the slider means.

DESCRIPTION OF THE PREFERRED EMBODIMENT

Figure 1:
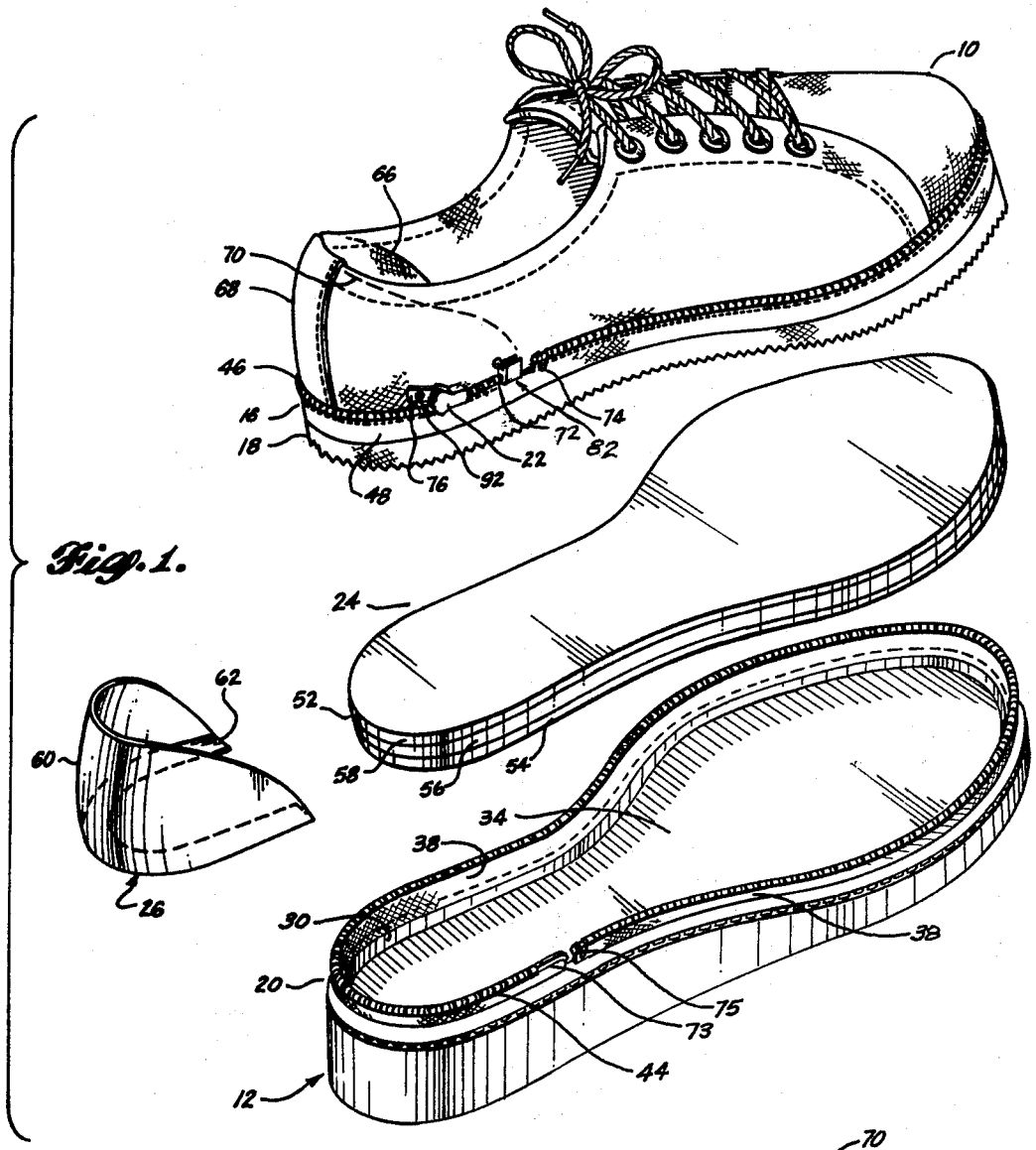
FIG. 1 is an exploded pictorial view of an embodiment of the present invention.

Referring initially to FIG. 3, shown in a side elevational view, is a typical shoe constructed according to the instant invention. In preferred form, it comprises an upper 10 detachably connected to a sole 12 by slide fastener means 14 extending around the perimeter of both upper 10 and sole 12. Said slide fastener means has an upper stringer 16 attached to lower edge portion 18 of upper 10, a lower stringer 20 attached to sole 12, and slider means 22 to couple and uncouple said stringers.

A removable insole 24 is insertable into the shoe. Furthermore, a heel cup 26, for reinforcing the heel region of upper 10 by stiffening the heel region of the upper so that it will in turn provide the necessary amount of support for the user's foot, is receivable in a heel pocket 28 formed at the rear of upper 10. In some types of shoes the heel cup 26 may be affixed permanently in the pocket 28. In others it may be removable so that heel cups of different degrees of stiffness may be substituted when a sole change is made. For example, a shoe equipped with a jogging sole may require only a small amount of reinforcement at the heel. However, if the jogging sole were to be replaced with a football sole, a much stiffer heel cup would have to be used to make the shoe suitable for football use.

Sole 12 is constructed from a tread portion 30 and an upstanding side wall 32 of generally rectangular cross section extending upward of and around the perimeter of said tread portion. Tread portion 30 is shown in FIGS. 1, 5 and 6 as having a treaded bottom surface 36. It is to be understood that tread portion 30 can be made from various materials, in various thicknesses, and with varying flexibilities depending upon the particular use and fit desired. Also, tread surface 36 can be formed in a variety of molded patterns to accommodate the intended use of the shoe. Said tread portion, furthermore, can be constructed to receive separate and/or removable traction devices such as spikes used in golfing shoes or cleats used in baseball shoes.

Now referring specifically to FIGS. 1, 5 and 6, the lower stringer 20 of slide fastener means 14 is shown as including lower stringer mounting tape 38 attached to the inside surface of and extending along the entire length of sole side wall 32. Said mounting tape may be bonded with an adhesive and/or stitched with stitching 40, to said sole side wall. As best seen in FIGS. 5 and 6, in a shoe in which stitching is employed, the sole is preferably constructed to include a groove 42. The stitching 40 extends through the sole side wall 32 at an elevation corresponding to that of groove 42. This particular construction enables stitching 40 to remain within the outer profile of sole 12 to thus protect said stitching from being chafed or abraided while the shoe is being worn. Lower stringer mounting tape 38 extends downwardly along side of sole side wall 32; it also extends upwardly to carry along its upper edge, lower stringer coupler means 44. Said coupler means is carried upwardly directed and at an elevation sufficient to allow slider means 22 to pass freely over the top surface of sole side wall 32. The closer the coupler means 44 are to the upper edge of side wall 32 the more support can be obtained from the side wall to prevent excess flexing of the mounting tape. Even with the coupler means 44 virtually resting on the side wall, the slider can pass by flexing the upper side wall portion lying above the stitch line 40.

The upper 10 is shown in FIGS. 1, 3 and 4 as being of a style commonly used in athletic type shoes. It is to be understood that uppers of enumerable styles, colors and materials can be provided to be detachably connected to various soles. Furthermore, uppers can be provided with a variety of reinforcements to provide shoes having a range of support and flex characteristics to attain maximum comfort and performance from the shoe.

Upper 10 has a lower edge portion 18 extending around the perimeter of said upper and extending downward parallel to and substantially to the full depth of sole side wall 32, as shown in FIG. 5. Said lower edge portion serves to pad the foot from slide fastener means 14, and to some degree may serve to seal the inside of the shoe from dust or moisture which is unavoidably transmitted through the open spaces between the coupler means 44 of lower stringer 20 and the coupler means 46 of upper stringer 16.

Upper stringer 16, as best shown in FIGS. 5 and 6, includes upper stringer mounting tape 48, which mounting tape is stitched to the outside surface of lower edge portion 18 of upper 10 at an elevation to permit the lower edge of said mounting tape to lie below lower stringer coupler means 44 when the shoe is assembled. Furthermore, said mounting tape extends around the entire perimeter of said upper. It is to be understood that other well-known methods of attaching upper stringer mounting tape 48 to lower edge portion 18, such as by gluing or taping, can be utilized. When the shoe is unassembled, upper stringer mounting tape 48 extends upwardly along the outside surface of upper 10 to carry along its "top" edge, upper stringer coupler means 46 in upward direction, as shown in dot-dash lines in FIG. 6. But to assemble upper 10 to sole 12, upper stringer mounting tape 48 is folded outwardly and downwardly over on itself to form an upwardly directed bight 50. With upper stringer mounting tape 48 turned over in this fashion, upper stringer coupler means 46 depends downwardly from said tape at an elevation directly above the lower stringer coupler means 44 to enable said two coupler means to be coupled together by slider means 22.

Folding upper stringer mounting tape 48 outwardly and downwardly over on itself creates the advantage of enabling the portion of said mounting tape, which lies against lower edge portion 18, to provide an extra layer of padding between the inside of the shoe and slide fastener means 14. This extra layer of padding would not exist if said upper stringer mounting tape 48 were attached to upper 10 in a manner analogous to the manner in which the lower stringer mounting tape 38 is attached to sole side wall 32. This particular construction, moreover, causes the lower and upper coupler means 44 and 46, respectively, to be pushed laterally outward from upper 10 to a location over the top of sole side wall 32. Thus, side wall 32, rather than the two coupler means, bears against the side of a foot to restrain and position such foot. Therefore, the foot will not be injured by impacting against slide fastener means 14 nor will said slide fastener means be required to absorb large impulse forces imparted by the foot, thus prolonging the life of said slide fastener means. Furthermore, because upper stringer mounting tape 38 is relatively stiff, when it is folded over on itself, it helps shape the adjacent portion of upper 10. Specifically, it helps give the upper a rounded shape, as shown in FIG. 5, in the same manner as in a conventional shoe.

Removable insole 24, shown in FIGS. 1, 2, 5 and 6 has an outer edge 52 which is contoured to match the outline of the outer edge of sole 12 for permitting said insole to be closely receivable within sole side wall 32. Insole 24, by closely fitting within sole side wall 32, enables insole outer edge 52 to clamp the lower edge portion 18 of upper 10 and the lower stringer mounting tape 38 to the inside surface of sole side wall 32, resulting in said lower edge portion being prevented from riding upwardly while the shoe is being worn.

Insole 24 is shown in FIGS. 1, 2, 5 and 6 as being composed of three separate layers. Bottom layer 54 is constructed from a relatively stiff material to provide strength in the lateral direction for maintaining lower edge portion 18 of upper 10 clamped against sole side wall 32. A middle layer 56 is bonded to bottom layer 54, which middle layer is composed of resilient material for absorbing shock loads that are imparted on the shoe. Lastly, a top layer 58, made from moisture absorbing material, is bonded to middle layer 56. The top and middle layers also are capable of conforming to the shape of the foot of the wearer. Consistent with the objects of this invention, soles made in varying numbers of layers, in different thicknesses, and of materials having a range of firmness and flex characteristics can be provided to assure optimum comfort to the wearer to enable maximum shoe performance for a particular usage, and, furthermore, to accommodate various sole designs.

Figure 2:
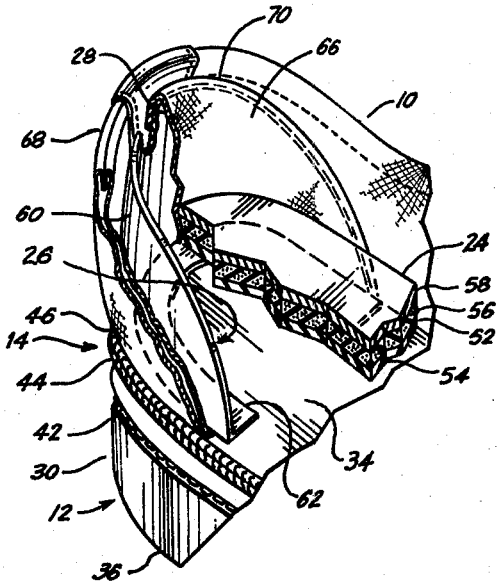
FIG. 2 is a fragmentary pictorial view of the shoe shown in FIG. 1 with portions broken away, illustrating the construction of the heel pocket and the installation of the heel cup.

A removable heel cup 26, shown in FIGS. 1 and 2, is provided for retaining the shape of upper 10. Said heel cup is constructed of a generally U-shaped, upstanding wall portion 60 and an arcuate flange 62, which flange extends horizontally inwardly from the bottom edge of said upstanding wall portion. A heel pocket 28 is formed by panel 66 and the inside surface of heel end portion 68 of upper 10. Said panel is attached to said heel end portion along arcuate upper edge 70 of said panel. Thus, an opening exists along the bottom edge of panel 66 to allow heel cup 26 to be upwardly received into heel pocket 64. Heel cup flange 62 is positioned between the top surface of sole tread portion 30 and the bottom surface of insole 24 so that said heel cup is locked into position by the combination of heel pocket 28 and the weight of the wearer bearing down on insole 24. Because heel cup 26 is removable, it can be replaced by heel cups of different shapes and thicknesses to accommodate the particular use of the shoe.

Now referring specifically to FIG. 1, it can be seen that upper stringer 16 and lower stringer 20 have beginning end portions 72 and 73, respectively and ending end portions 74 and 75, respectively. Said corresponding beginning and ending end portions abut each other at a location on the outside of the shoe and generally below the ankle of the wearer. Locating said beginning end portions and said ending end portions here, rather than on the opposite edge of the shoe, will reduce the likelihood that slider means 22 of a left and right shoe will become entangled while the shoes are being worn. Furthermore, preferably, upper and lower stringer beginning end portions 72 and 73, respectively, are positioned rearward of upper and lower stringer ending end portions 74 and 75, respectively, so that when the shoes are assembled, pull tab 76 of slider means 22 is oriented so that the free end of said pull tab is directed toward the heel end 68 of the shoe. This will reduce the likelihood that pull tab 76 will become hooked by an object brushing along the outside of the shoe.

As best illustrated in FIG. 7, securing means 78 is provided for maintaining slider means 22 engaged with upper and lower stringer beginning end portions 72 and 73, respectively, to thus prevent upper stringer coupler means 46 from becoming accidentally uncoupled from lower stringer coupler means 44. Said securing means includes catch means 80, which catch means has a stringer cup 82 fixedly attached to the beginning end portion 72 of upper stringer 16. Beginning end portion 73 of lower stringer 20 is slidably receivable within slot 84 of stringer cup 82 to lie in adjacent relationship, parallel to beginning end portion 72 of upper stringer 16. A post 86 is fixedly attached to and extends outwardly from stringer cup 82. Said post includes a necked portion 88 adjoining the outer surface of stringer cup 82 and a ball portion 90 fixedly attached to the free end of said necked portion. A circular hole 92, of a diameter slightly smaller than ball portion 90, but larger than necked portion 88, is provided in pull tab 76, which pull tab is preferably made from elastic material. To latch slider means 22 with upper and lower stringer end portions 72 and 73, respectively, pull tab 76 is simply pivoted toward said stringer beginning end portions and engaged with catch means 80. To pass pull tab hole 92 over ball portion 90, said hole must expand slightly when it is pressed against said ball portion. With pull tab 76 thus forceably snapped over ball portion 90, said pull tab is prevented from accidentally disengaging from catch 87. Both stringer cup 82 and slider means 22 are depicted in FIGS. 1 and 7 as being attached to upper stringer 16; however, they can both, instead, be attached to lower stringer 20 without affecting their respective functions.

The shoe of the instant invention can be disassembled, for instance to replace a worn-out upper, by first removing insole 24 from the interior of the shoe. Next pull tab 76 is unlatched from catch 86, and then slider means 22 is pulled along the length of lower and upper stringers 16 and 22, respectively, thereby uncoupling lower stringer coupler means 44 from upper stringer coupler means 46. With upper 10 thus detached from sole 12, heel cup 26 can be removed from heel pocket 28 and inserted into the heel pocket of the replacement upper. Thereafter, the upper stringer mounting tape of the replacement upper is folded outwardly and downwardly over on itself so that upper stringer coupler means 46 can be coupled to lower stringer coupler means 44 by slider means 22. Lastly, pull tab 76 is latched with catch 86 and insole 24 is reinserted into the shoe.

What is claimed is:

1. A shoe comprising:

(a) a sole having a tread portion and an upstanding side wall extending around the perimeter of said tread portion;

(b) an upper having a lower edge portion extending around the perimeter of said upper; and, (c) slide fastener means for detachably connecting said upper to said sole, said slide fastener means including, (1) a lower stringer comprising a lower stringer mounting tape and first coupler means extending along an edge thereof, said lower stringer mounting tape being attached to the inside surface of said sole side wall and supporting said first coupler means along the perimeter of said sole at an elevation above the top of said sole side wall, (2) an upper stringer comprising an upper stringer mounting tape and second coupler means extending along an edge thereof, said upper stringer mounting tape being attached to said upper along the outside surface of said lower edge portion of said upper with said second coupler means directed upwardly, said upper stringer tape being folded outwardly and downwardly over on itself both to form an upwardly directed bight and to locate the second coupler means in a depending position laterally outwardly of said upper and above the top of said sole side wall, and (3) slider means for coupling and uncoupling the first and second coupler means on said lower and said upper stringers.

2. A shoe according to claim 1, further comprising an insole contoured corresponding to the outline of the outer edge of said sole for being closely receivable within said sole side wall, said insole and sole side wall sandwiching therebetween said lower stringer tape and said lower edge portion of said upper.

3. A shoe according to claim 2, wherein said insole includes a relatively stiff bottom for giving said insole lateral strength, a resilient middle layer bonded to said bottom layer for absorbing shock transmitted to the shoe, and a moisture absorbing top layer bonded to said middle layer.

4. A shoe according to claim 2, further comprising a heel pocket formed by said upper, and a removable heel cup insertable into said heel pocket for reinforcing said upper.

5. A shoe according to claim 4, wherein said heel cup includes an arcuate flange extending horizontally inwardly from the bottom edge of said heel cup, said flange being located between said thread portion and said insole.

6. A shoe according to claim 1, wherein:

said upper and said lower stringers include abutting beginning and end portions, and means for securing said slider means to said upper and lower stringer beginning end portions for maintaining interlocked, said upper and said lower stringers.

7. The shoe according to claim 6, wherein the securing means includes a catch means fixedly attached to said beginning end portion of said upper stringer; and a pull tab pivotally connected to said slider means, said pull tab being engageable with said catch means.

* * * * *